US007063309B2

(12) United States Patent
Colman

(10) Patent No.: US 7,063,309 B2
(45) Date of Patent: Jun. 20, 2006

(54) MATTRESS SPRING STRUCTURE

(75) Inventor: Graham Colman, Sandton (ZA)

(73) Assignee: Bedding Component Manufacturers (Proprietary) Limited, Gauteng (ZA)

( * ) Notice: Subject to any disclaimer, the term of this patent is extended or adjusted under 35 U.S.C. 154(b) by 55 days.

(21) Appl. No.: 10/949,863

(22) Filed: Sep. 24, 2004

(65) Prior Publication Data

US 2006/0037138 A1 Feb. 23, 2006

(30) Foreign Application Priority Data

Aug. 18, 2004 (ZA) ..... 2004/6572

(51) Int. Cl.
*A47C 23/04* (2006.01)
*F16F 13/00* (2006.01)

(52) U.S. Cl. ..... 267/91; 267/103; 5/716; 5/248; 5/655.7

(58) Field of Classification Search ..... 5/716, 5/248, 655.7, 230, 246, 256; 267/91, 103
See application file for complete search history.

(56) References Cited

U.S. PATENT DOCUMENTS

| | | | | |
|---|---|---|---|---|
| 1,387,744 | A * | 8/1921 | Van Hove | 5/252 |
| 1,903,619 | A * | 4/1933 | Canfield | 5/721 |
| 2,348,897 | A * | 5/1944 | Gladstone | 267/93 |
| 2,978,715 | A * | 4/1961 | Blecker | 5/716 |
| 6,375,169 | B1 * | 4/2002 | McCraw et al. | 267/75 |
| 6,658,682 | B1 * | 12/2003 | Wells | 5/655.7 |

FOREIGN PATENT DOCUMENTS

GB 2203938 A * 11/1988

* cited by examiner

*Primary Examiner*—Alexander Grosz
(74) *Attorney, Agent, or Firm*—Wood, Phillips, Katz, Clark & Mortimer

(57) ABSTRACT

The invention concerns a mattress spring structure that includes multiple spring assemblies. Each spring assembly comprises an array of open-ended spring coils. The spring assemblies are arranged in superimposed relationship with the individual spring coils of the respective assemblies registering in vertical alignment with one another. A membrane extends between each pair of superimposed assemblies and the assemblies are connected to one another to form a unitary structure.

9 Claims, 3 Drawing Sheets

MATTRESS SPRING STRUCTURE

BACKGROUND TO THE INVENTION

This invention relates to a mattress spring structure.

The term "mattress" is used broadly in this specification to refer to a resilient cushion for use as a bed mattress or as a cushion in other items of upholstered furniture, for example chairs or sofas.

In the case of a bed mattress, some persons may prefer a sleeping surface which is somewhat stiffer or less resilient than other persons. Also, some persons prefer a bulkier mattress, in the sense of having a greater vertical dimension, than other persons. A bulkier mattress can be obtained if longer springs, i.e. springs with a greater vertical height, are used. If a relatively stiff construction is required, the individual springs must then be of heavier wire in view of their longer length. However, the use of heavier wire may be uneconomical.

SUMMARY OF THE INVENTION

According to the invention there is provided a mattress spring structure including a plurality of spring assemblies each comprising an array of open-ended spring coils, the spring assemblies being arranged in superimposed relationship with the individual spring coils of the respective assemblies registering in vertical alignment with one another, a membrane extending between each pair of superimposed assemblies and means connecting the assemblies to one another to form a unitary structure.

In the preferred embodiments, where all the coil springs are of a type having a tendency to incline in a preferential direction when subjected to axial loading, the coil springs in one assembly have opposite orientations to the coil springs in a superimposed assembly. Typically each coil spring has an opposite orientation to a coil spring in the superimposed assembly with which it is vertically aligned.

There may, for instance, be two spring assemblies with a single membrane, preferably porous, between them. Each of the two spring assemblies can have the same vertical height. They may be connected to one another by connectors, typically ring-shaped elements, which embrace end turns of peripheral coil springs of the assemblies and also pass through the membrane. There may in addition be peripheral border wires which extend about an upper edge of an upper one of the two spring assemblies and about a lower edge of a lower one of the two spring assemblies respectively, coil springs of the upper and lower assemblies being connected to the upper and lower border wires respectively.

Conveniently the coil springs in each spring assembly are arranged in mutually orthogonal rows and columns, all coil springs in every row of each assembly, except for one row, being oriented similarly to one another and oppositely to the coil springs in the corresponding rows of the other assembly.

BRIEF DESCRIPTION OF THE DRAWINGS

The invention will now be described in more detail, by way of example only, with reference to the accompanying drawings in which.

DESCRIPTION OF PREFERRED EMBODIMENTS

Figure 1:
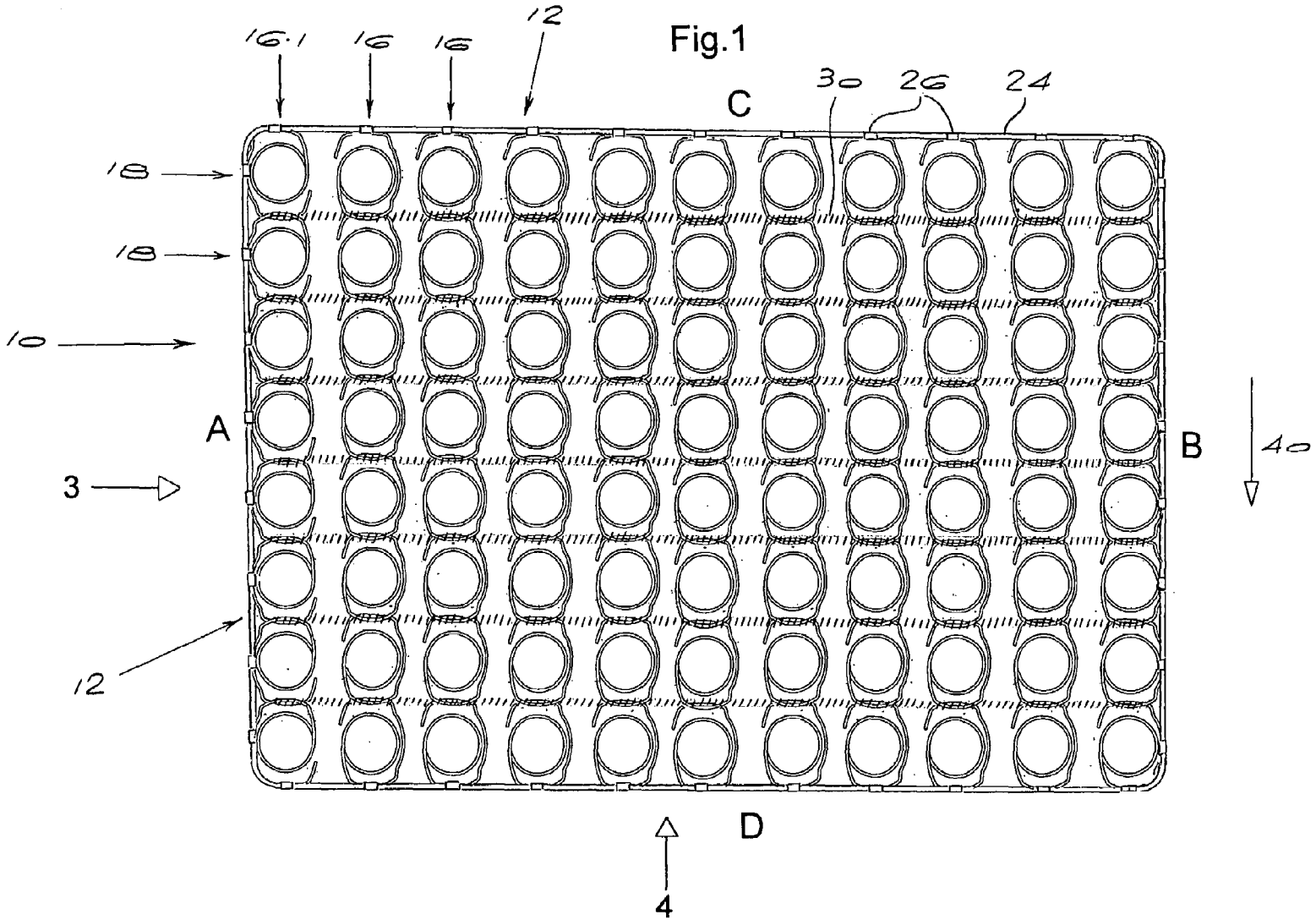
FIG. 1 shows a plan view on an upper spring assembly of a mattress spring structure according to the invention.

In the following description reference is made to a bed mattress and the terms "upper", "lower" and so on refer to a normal orientation of the mattress when used in this application.

The mattress spring structure 10 seen in the drawings includes upper and lower spring assemblies 12 and 14 respectively. The spring assemblies 12 and 14 are separately manufactured. Each assembly includes a large number of individual coil springs arranged in rows and columns.

The rows and columns of the upper spring assembly 12 are designated by the numerals 16 and 18 respectively while the rows and columns of the lower spring assembly 14 are designated by the numerals 20 and 22 respectively.

All the springs are open-ended springs, and in the illustrated embodiment are so-called LFK springs. In each case, the uppermost and lowermost turns of the spring are generally U-shaped and lie in generally horizontal planes.

The springs in the rows 16 and columns 18 of the upper spring assembly 12 are aligned vertically with the springs 20 and 22 in the lower spring assembly 14. To facilitate an understanding of the orientation of the structure 10 in FIGS. 1 and 2, the letters A, B, C and D indicate the same sides of the structure in both views.

Figure 2:
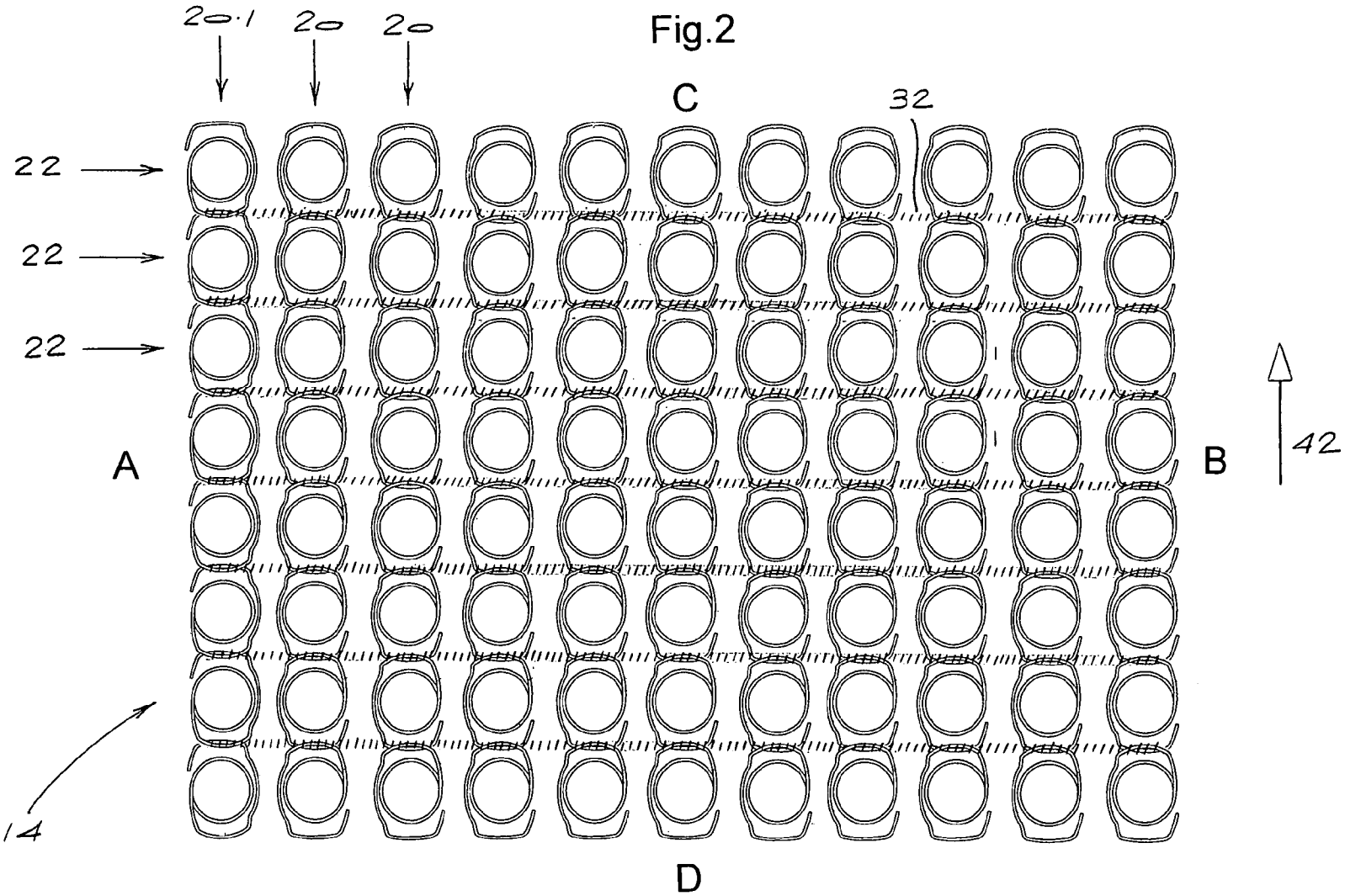
FIG. 2 shows a plan view, at the line 2—2 in FIG. 3, on a lower spring assembly of the mattress spring structure.
Figure 3:
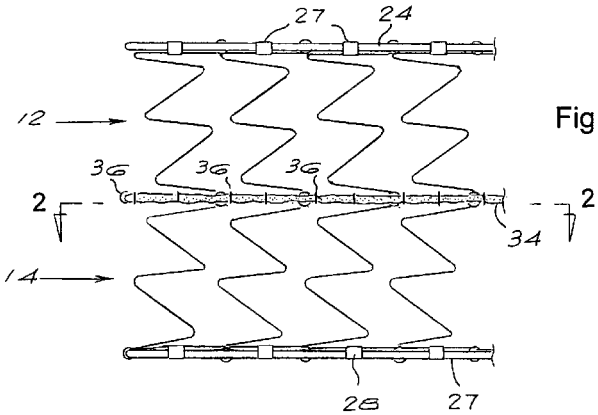
FIG. 3 shows a side view in the direction of the arrow 3 in FIG. 1.
Figure 4:
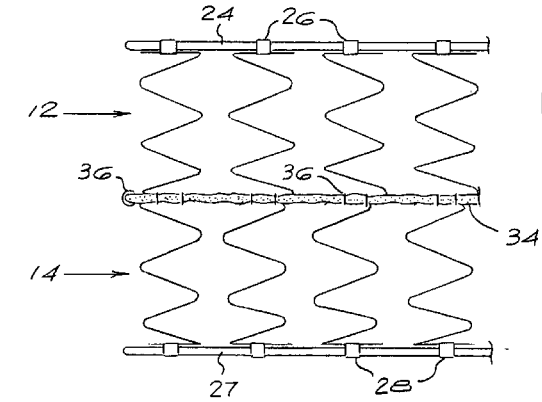
FIG. 4 shows a side view in the direction of the arrow 4 in FIG. 1.
Figure 5:
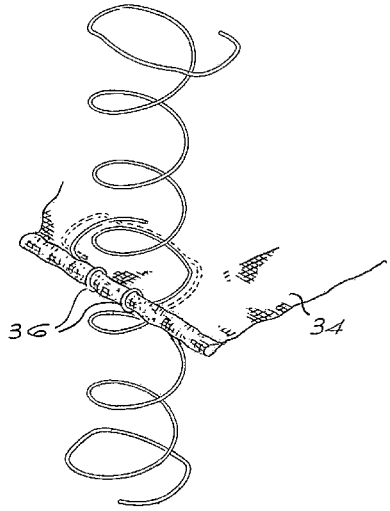
FIG. 5 shows, in a perspective detail, how an edge coil spring of the upper spring assembly is connected to the aligned edge coil spring of the lower spring assembly in the embodiment of FIGS. 1 to 4.

It will be seen in FIG. 1 that in the upper assembly all the springs in every row 16, with the exception of the end row 16.1, are oriented the same way. In the row 16.1 the springs are oriented oppositely to those in the other rows 16. In FIG. 2 it will be seen that in the lower assembly all springs with the exception of those in the end row 20.1, which lies directly beneath the end row 16.1, are oriented the same way as one another. In the row 20.1 the springs are oriented oppositely to those in the other rows 20.

From a comparison of FIGS. 1 and 2 it will be seen that each spring in the lower assembly 14 is reversed, i.e. oriented the opposite way, with respect to the vertically aligned spring in the upper assembly 12.

A border wire 24 extends about the upper periphery of the upper assembly 12 and is connected to those coil springs located at the edge of the assembly by clips 26. Similarly, a border wire 27 extends about the lower periphery of the lower assembly 14 and is connected to the coil springs at the edges by clips 28.

Coil springs in the columns 18 of the upper assembly are connected to coil springs in adjacent columns 18 by means of helical connector wires 30.

Similarly, coil springs in the columns 22 of the lower assembly are connected to coil springs in adjacent columns 22 by helical connector wires 32.

In each spring assembly the combination of border wires and helical connector wires connects the various coils to one another to form a unitary construction.

As indicated above, the assembly 12 is arranged over the assembly 14. Between the two assemblies there is a porous membrane 34 provided by a rectangular expanse of a flexible fabric, in this embodiment spun bond fly screen material. The upper and lower assemblies 12 and 14 are connected to one another peripherally by means of hog rings 36 which pass through the edges of the membrane 34 and embrace the lowest turns of the peripheral coil springs in the upper assembly and the top turns of the peripheral coil springs in the lower assembly. It will accordingly be understood that the hog rings 36 serve to connect the assemblies 12 and 14 to one another, with the membrane between them, to form the unitary structure 10.

In use, the structure 10 is upholstered, typically with padded quilt, in order to form the final mattress in which the spring structure is completely concealed.

An advantage of the illustrated embodiment is the fact that it is possible to achieve a bulky spring structure, i.e. one with a substantial vertical dimension, from two spring assemblies of relatively low vertical height. In a typical example it is possible with the invention to produce a mattress spring structure with a height of 200 mm from two assemblies 12 and 14 of 100 mm height, compared to a typical, conventional spring structure height of 150 mm.

Thus it is possible in each assembly to achieve a desirable level of overall stiffness with relatively short coils formed of moderate diameter spring wire.

Those skilled in the art will understand that open-ended coil springs, such as the illustrated LFK springs, have a tendency to incline in one preferential direction when subjected to vertical loading. In the illustrated embodiment, the vast majority of the springs in the upper assembly 12, with the exception of those in the row 16.1, are similarly oriented, so this assembly as a whole will typically have a tendency to incline in a preferential direction 40 under load. The vast majority of the springs in the lower assembly, with the exception of those in the row 20.1, are similarly oriented so this assembly as a whole will typically have a tendency to incline in a preferential direction 42 under load. The directions 40 and 42 are opposite to one another because of the reversed orientations of the springs in the respective assemblies. Thus the inclinational tendencies of the upper and lower assemblies tend to counteract one another, leading to a stable mattress structure.

In less preferred embodiments, the springs in the upper and lower assemblies may all be oriented the same way. However, in this case there may be a tendency for the spring structure as a whole to exhibit some lateral instability as a result of the similar inclinational tendencies of the springs.

In yet other embodiments it would be possible to include, in each assembly 12 or 14, springs with different orientations so that the inclinational tendencies of the springs in each assembly will tend to counteract one another and thereby promote lateral stability of each assembly and, as a result, lateral stability of the mattress spring structure as a whole.

The invention also extends to mattress spring structures having more than two individual spring assemblies interconnected with one another in superimposed relationship, preferably with the springs in at least one of the assemblies being oriented oppositely to the springs in other assemblies to promote lateral stability. It will be understood that in such embodiments, there will be a membrane between each pair of superimposed spring assemblies.

The invention claimed is:

1. A mattress spring structure including a plurality of spring assemblies each comprising an array of open-ended spring coils, the spring assemblies being arranged in superimposed relationship with the individual spring coils of the respective assemblies registering in vertical alignment with one another, a membrane extending between each pair of superimposed assemblies and means connecting the assemblies to one another to form a unitary structure wherein all the coil springs are of a type having a tendency to incline in a preferential direction when subjected to axial loading, and wherein the coil springs in one assembly have opposite orientations to the coils in a superimposed assembly.

2. A mattress spring assembly according to claim 1 wherein each coil spring has an opposite orientation to a coil spring in the superimposed assembly with which it is vertically aligned.

3. A mattress spring assembly according to claim 2 comprising two spring assemblies with a single membrane between them.

4. A mattress spring assembly according to claim 3 wherein the membrane is porous.

5. A mattress spring assembly according to claim 3 wherein each of the two spring assemblies has the same vertical height.

6. A mattress spring assembly according to claim 3 wherein the spring assemblies are connected to one another by connectors which embrace end turns of peripheral coil springs of the assemblies and also the membrane.

7. A mattress spring assembly according to claim 6 wherein the connectors are ring-shaped elements which embrace the end turns of the coil springs and pass through the membrane.

8. A mattress spring assembly according to claim 3 and including peripheral border wires which extend about an upper edge of an upper one of the two spring assemblies and about a lower edge of a lower one of the two spring assemblies respectively, coil springs of the upper and lower assemblies being connected to the upper and lower border wires respectively.

9. A mattress spring assembly according to claim 8 wherein the coil springs in each spring assembly are arranged in mutually orthogonal rows and columns, all coil springs in every row of each assembly, except for one row, being oriented similarly to one another and oppositely to the coil springs in the corresponding rows of the other assembly.

* * * * *